US012379177B2

(12) United States Patent
Smathers et al.

(10) Patent No.: US 12,379,177 B2
(45) **Date of Patent: *Aug. 5, 2025**

(54) CAPTIVE MAINSPRING AND INTEGRAL BEAVERTAIL

(71) Applicant: OA DEFENSE LLC, Dayton, NV (US)

(72) Inventors: Joseph Smathers, Dayton, NV (US); Todd Powers, Dayton, NV (US)

(73) Assignee: OA DEFENSE LLC, Dayton, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/228,379

(22) Filed: Jul. 31, 2023

(65) Prior Publication Data

US 2024/0035770 A1 Feb. 1, 2024

Related U.S. Application Data

(60) Provisional application No. 63/393,552, filed on Jul. 29, 2022.

(51) Int. Cl.
*F41A 19/14* (2006.01)

(52) U.S. Cl.
CPC ..... *F41A 19/14* (2013.01)

(58) Field of Classification Search
CPC ..... F41A 19/14
USPC ..... 42/69.03, 59; 89/147
See application file for complete search history.

(56) References Cited

U.S. PATENT DOCUMENTS

| | | | | |
|---|---|---|---|---|
| 984,519 | A | 2/1911 | Browning | |
| 1,410,266 | A | 3/1922 | Pedersen | |
| 3,365,829 | A | 1/1968 | Shockey | |
| 3,682,040 | A | 8/1972 | Roy | |
| 4,023,296 | A | 5/1977 | Frisoli | |
| 4,338,740 | A | 7/1982 | Miller | |
| 4,539,770 | A | 9/1985 | Bornancini | |
| 4,593,487 | A | 6/1986 | Ruger | |
| 4,709,497 | A | 12/1987 | Resca | |
| 6,116,137 | A | 9/2000 | Strahan | |
| 6,205,694 | B1 * | 3/2001 | Davis, Sr. | F41A 19/14 42/70.08 |
| 6,269,576 | B1 * | 8/2001 | Williams | F41A 17/74 42/70.11 |
| 6,283,006 | B1 * | 9/2001 | Szabo | F41A 17/74 89/154 |
| 9,068,790 | B2 | 6/2015 | La Vigne | |
| 10,000,000 | B2 | 6/2018 | Marron | |
| 10,794,648 | B2 | 10/2020 | Henninger et al. | |
| 11,022,388 | B1 * | 6/2021 | Noonan | F41A 19/14 |
| 11,320,234 | B1 * | 5/2022 | Simon | F41A 17/20 |
| 12,007,199 | B2 * | 6/2024 | Smathers | F41C 23/10 |

(Continued)

FOREIGN PATENT DOCUMENTS

WO 2018102458 A2 6/2018

OTHER PUBLICATIONS

International Search Report and Written Opinion dated Oct. 19, 2023 issued in PCT/US2023/29136.

*Primary Examiner* — Reginald S Tillman, Jr.
(74) *Attorney, Agent, or Firm* — HUNTON ANDREWS KURTH LLP

(57) ABSTRACT

A firearm with a mainspring assembly and a beavertail element integral to the frame. The firearm may include a mainspring assembly coupled to a lower portion of the frame, a hammer strut extending between the hammer and the mainspring assembly.

14 Claims, 3 Drawing Sheets

(56) References Cited

U.S. PATENT DOCUMENTS

| | | | |
|---|---|---|---|
| 2013/0269233 | A1 | 10/2013 | Chin |
| 2018/0058792 | A1 | 3/2018 | Schirmer |
| 2019/0041150 | A1 | 2/2019 | Lopata et al. |
| 2019/0137206 | A1 | 5/2019 | Lopata |
| 2020/0025501 | A1 | 1/2020 | Price |
| 2021/0131764 | A1 | 5/2021 | Padovan |

* cited by examiner

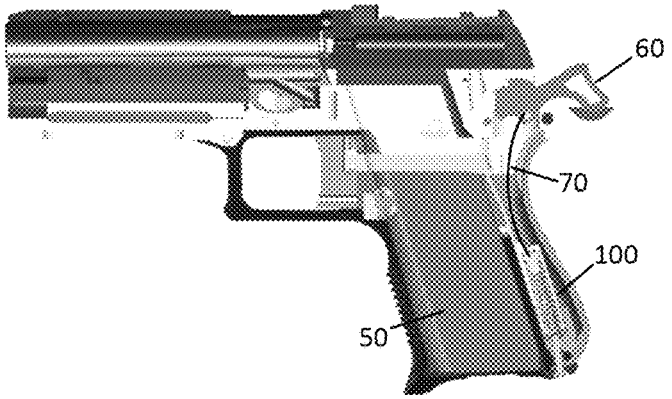
FIG. 2A
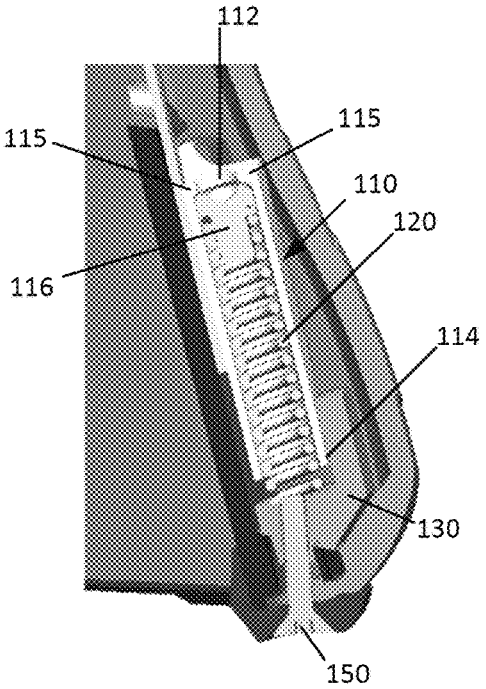
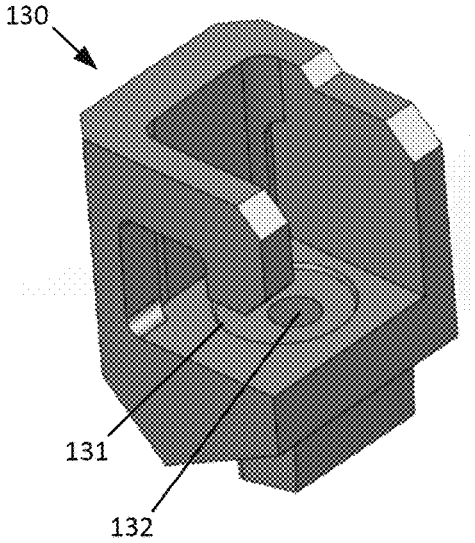
FIG. 2C
FIG. 2B

CAPTIVE MAINSPRING AND INTEGRAL BEAVERTAIL

CROSS-REFERENCE TO RELATED APPLICATIONS

This application claims priority to U.S. Provisional Application No. 63/393,552 filed Jul. 29, 2022, which application is incorporated by reference herein.

FIELD OF THE DISCLOSURE

The present invention relates generally to firearms. More specifically, the present invention is concerned with an improved single-action, recoil-operated, semi-automatic pistol.

BACKGROUND

Hand pistols taught by U.S. Pat. No. 984,519 (incorporated herein by reference), or some variation thereof, (each a "1911") have been in production for over one-hundred years. During that time, the 1911 has developed a loyal following for a variety of reasons. Unfortunately, certain features of the 1911 are not optimized. Accordingly, it would be beneficial to have a firearm that is capable of satisfying 1911 loyalists while improving upon certain non-optimized features.

A 1911 includes a frame, a hammer pivotally coupled to an upper portion of the frame, a mainspring housing coupled to a lower portion of the frame, and a hammer strut extending between the hammer and the mainspring housing. The mainspring housing houses a mainspring, which provides the driving force for rotating the hammer from a cocked position to a firing position during a firing sequence. A proximal end of the hammer strut is pivotally coupled to the hammer and a distal end of the hammer strut is engaged with a top end of a mainspring. More specifically, the distal end of the hammer strut is engaged with a mainspring cap, and the mainspring cap is engaged with the top end of the mainspring.

Existing 1911 mainspring housings are pinned to the frame. In some embodiments, opposed flanges of the mainspring housing engage with corresponding channels of the frame prior to the mainspring housing being slid up and into position relative to the frame. The mainspring housing is then pinned to the frame, thereby preventing the mainspring housing from sliding out of position. By retaining the position of the mainspring housing relative to the frame, the mainspring's position is also retained. While presumably satisfactory in certain circumstances, it would be beneficial to have an alternative method of securing the mainspring's position. It would further be beneficial to have attachment methods that are more convenient than existing pin configurations for retaining the position of the mainspring.

A 1911 requires the hammer assembly to be installed before the mainspring housing can be installed. In some existing 1911 configurations, a back panel is then installed over the mainspring housing and the internal firing mechanisms. For some 1911 configurations, the back panel includes a beavertail. Other 1911 configurations include a grip safety having a beavertail. In each configuration, the beavertail is separate from the frame. Accordingly, it would be beneficial to have a 1911-style firearm that includes a beavertail that is integral with the frame. It would further be beneficial to have a method of manufacturing a 1911-style firearm in a manner that allows for the beavertail to be integral with the frame.

When moving the 1911 to a cocked configuration, the hammer is rotated to a cocked position, which causes the hammer strut to compress the mainspring. To retain constant reliable engagement of the hammer strut with the mainspring cap, the 1911 is designed such that the mainspring remains compressed, at least slightly, even when the hammer is rotated away from the cocked position, such as when the 1911 is in an un-cocked or firing configuration. In other words, when the 1911 is fully assembled, the mainspring includes some level of preload regardless of the configuration of the firearm. Unfortunately, the mainspring preload can create some issues associated with installing and removing the mainspring housing from the frame. Accordingly, it would be beneficial to have a system for and method of installing and removing the mainspring without requiring the mainspring to be preloaded.

These and other deficiencies exist. Therefore, there is a need to provide [invention] that overcome these deficiencies.

SUMMARY OF THE DISCLOSURE

In some aspects, the techniques described herein relate to a firearm including: a frame; a hammer pivotally coupled to an upper portion of the frame; a mainspring assembly coupled to a lower portion of the frame; a hammer strut extending between the hammer and the mainspring assembly; the mainspring assembly including: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame; a retention mechanism configured to secure the mainspring assembly in position relative to the frame, thereby securing the position of the mainspring relative to the frame; wherein the retention mechanism extends through a portion of the frame into engagement with the retention clip, securing the mainspring assembly relative to the frame by way of the retention clip.

In some aspects, the techniques described herein relate to a mainspring assembly including: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame;

In some aspects, the techniques described herein relate to a method of assembling a firearm: engaging a mainspring assembly with a frame of the firearm, wherein the mainspring assembly includes: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame; sliding the mainspring assembly vertically downward into position relative to the frame; securing the mainspring assembly to the frame, thereby securing a mainspring of the mainspring assembly in position relative to the frame; installing a hammer and a hammer strut after the mainspring assembly is secured in position.

Further features of the disclosed systems and methods, and the advantages offered thereby, are explained in greater detail hereinafter with reference to specific example embodiments illustrated in the accompanying drawings.

BRIEF DESCRIPTION OF THE DRAWINGS

In order to facilitate a fuller understanding of the present invention, reference is now made to the attached drawings. The drawings should not be construed as limiting the present invention, but are intended only to illustrate different aspects and embodiments of the invention.

FIG. 2A is a sectional side view of a hand pistol of the present invention.

FIG. 2B shows a portion of FIG. 2A, on an enlarged scale, the hammer strut being removed for clarity.

FIG. 2C is a perspective view of a retention clip of the present invention.

DETAILED DESCRIPTION

Exemplary embodiments of the invention will now be described in order to illustrate various features of the invention. The embodiments described herein are not intended to be limiting as to the scope of the invention, but rather are intended to provide examples of the components, use, and operation of the invention.

Furthermore, the described features, advantages, and characteristics of the embodiments may be combined in any suitable manner. One skilled in the relevant art will recognize that the embodiments may be practiced without one or more of the specific features or advantages of an embodiment. In other instances, additional features and advantages may be recognized in certain embodiments that may not be present in all embodiments.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The present invention comprises a highly modified 1911 hand pistol (the "2311"). The 2311 is similar enough to a 1911 to satisfy most loyalists, while resolving certain deficiencies associated with the 1911. Like the 1911, the 2311 utilizes a mainspring and a hammer strut. Unlike the 1911, the 2311 does not rely on existing pin configurations for retaining the position of the mainspring. Some embodiments of the 2311 include a beavertail that is integral with the frame. Furthermore, the present invention includes a method of manufacturing a 2311 in a manner that allows the beavertail to be integral with the frame. In some embodiments, the 2311 facilitates installing and removing the mainspring without requiring the mainspring to be preloaded.

Figure 1A:
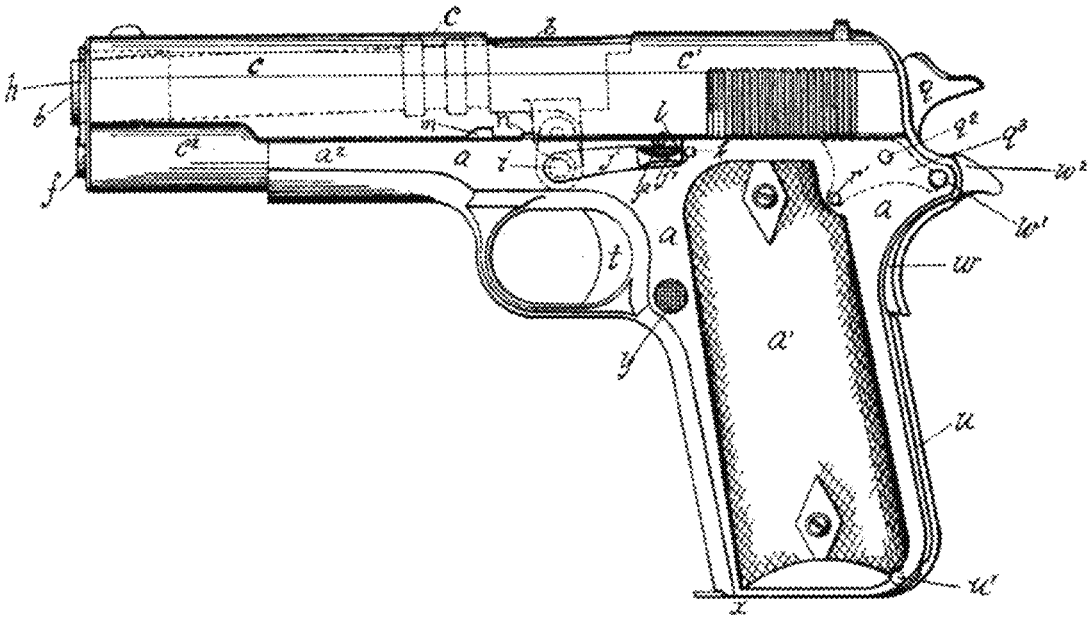
FIG. 1A is side view of a hand pistol of the prior art, the image taken from U.S. Pat. No. 984,519 (FIG. 1), the pistol shown in a rest configuration.

FIG. 1A is side view of a hand pistol of the prior art, the image taken from U.S. Pat. No. 984,519 (FIG. 1), the pistol shown in a rest configuration.

Figure 1B:
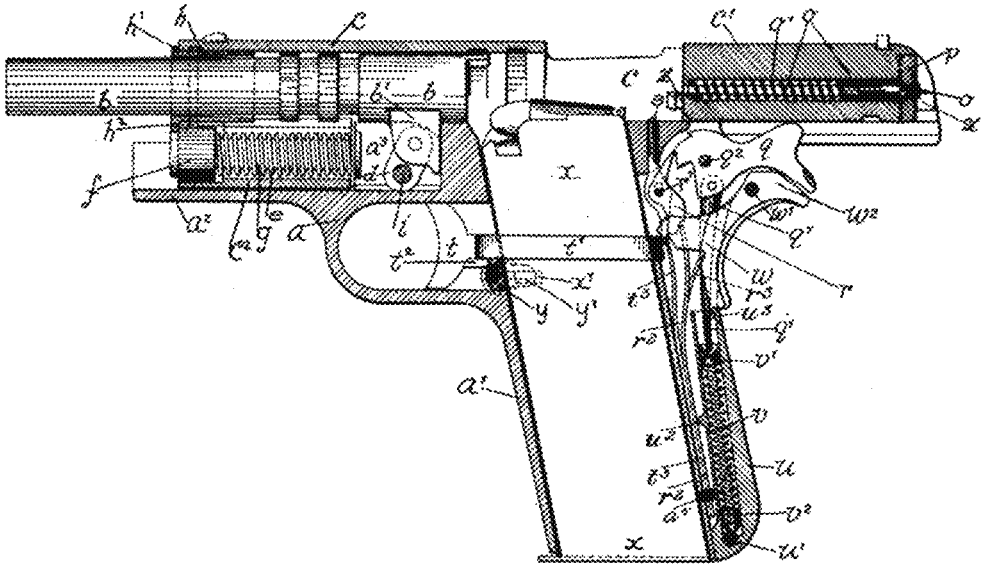
FIG. 1B shows the pistol of FIG. 1A in a loading configuration, a portion of the pistol removed to show internal components thereof.

FIG. 1B shows the pistol of FIG. 1A in a loading configuration, a portion of the pistol removed to show internal components thereof.

Referring to FIGS. 2A-2C, a firearm of the present invention includes a frame 50, which serves as the structural foundation of the firearm. The frame 50 comprises a rigid structure designed to accommodate various components and provide stability during operation. A hammer is pivotally coupled to an upper portion of the frame 50. The hammer 60 is a component responsible for striking the firing pin or primer of a cartridge, initiating the ignition process. A mainspring assembly 100 is coupled to a lower portion of the frame 50. The mainspring assembly 100 can be housed within the frame 50. The mainspring assembly 100 comprises a main body 110 which can house a mainspring 120 extending therefrom. The main body 110 acts as a housing for the mainspring 120 and provides support and guidance during the operation of the firearm. The main body 110 of the mainspring assembly 100 has a top end 112 that is open and that is specifically configured to receive a distal end of the hammer strut 70. The hammer strut 70 is a structural component extending between the hammer 60 and the mainspring assembly 100, transmitting force between them. Additionally, the top end 112 of the main body 110 serves as a retention mechanism, securely holding the top end of the mainspring 120 in place. Furthermore, the mainspring assembly 100 can include a receiving member 116 configured to receive the hammer strut 70. The receiving member 116 can be configured to be screw shaped, such as a mushroom shaped top and a cylindrical member extending into the mainspring 120. The mushroom top is designed to be stopped by the flanges 115. The mushroom top of the receiving member 116 can further include a dimple or recess or relief configured to meet with the distal end of the hammer strut 70. To ensure further retention and stability, the mainspring assembly 100 includes a retention clip 130 selectively secured to the second end 114 of the main body 110. The retention clip 130 acts as an additional retention mechanism, firmly securing the bottom end of the mainspring 120 within the mainspring assembly 100. By incorporating the hammer strut 70, main body 110, mainspring 120, and retention clip 130 into the firearm design, the present invention provides a reliable and secure mechanism for the controlled movement and operation of the hammer 60 and mainspring 120 within the firearm.

The main body 110 of the mainspring assembly 100 is specially designed to include corresponding opposed flanges 115. These opposed flanges 115 are protrusions or ridges on the main body 110 that align with and fit into the frame 50. The presence of flanges 115 facilitates slidable engagement of the mainspring assembly 100 with the frame 50. This arrangement allows for smooth and controlled movement of the mainspring assembly 100 within the frame 50, ensuring proper functioning of the firearm. In some embodiments, the mainspring assembly 100 further includes a retention mechanism 150. The retention mechanism 150 serves to secure the mainspring assembly 100 in position relative to the frame 50, thereby ensuring the stable and fixed positioning of the mainspring 120 relative to the frame 50. The retention mechanism 150 can take the form of a screw, a bolt, or similar fastening elements. It is configured to engage with corresponding threads or holes present in both the mainspring assembly 100 and the frame 50, providing a secure attachment. In certain embodiments, the retention mechanism 150 extends through a portion of the frame 50 into engagement with the retention clip 130. The retention clip 130 is a component located within the mainspring assembly 100 and serves as an additional retention mechanism for the mainspring 120. By extending through a portion of the frame 50 and engaging with the retention clip 130, the retention mechanism 150 not only secures the mainspring assembly 100 but also reinforces the attachment of the mainspring assembly 100 relative to the frame 50. The retention clip 130 can be configured to receive the mainspring 120 via a spring recess 131. The retention clip 130 can also include a retention insert 132 which can be a hole, insert, or threaded recess configured to fit the retention mechanism 150. This arrangement ensures the stability and proper functioning of the mainspring 120 within the firearm. The incorporation of the opposed flanges 115, retention mechanism 150, and retention clip 130 in certain embodiments of the firearm design provides enhanced structural integrity, secure attachment, and improved performance during firearm operation.

Figure 3A:
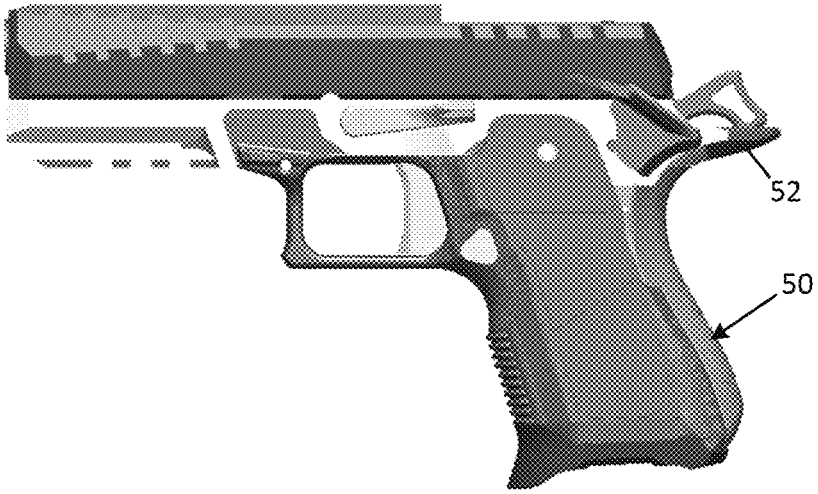
FIG. 3A is a side elevation view of the hand pistol of FIG. 2A.
Figure 3B:
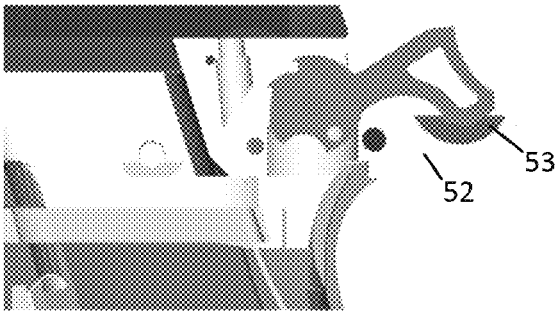
FIG. 3B shows a portion of FIG. 2A, on an enlarged scale.
Figure 3C:
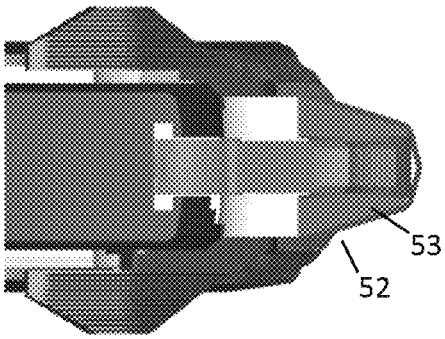
FIG. 3C shows a partial top plan view of the hand pistol of FIG. 2A.

Referring now to FIGS. 3A-3C, some firearms of the present invention include a frame 50 having an integral beavertail 52. An integral beavertail 52 refers to a design where the beavertail component is seamlessly incorporated into the frame 50 structure itself. It eliminates the need for a separate beavertail attachment, providing a streamlined and cohesive firearm design. The integral beavertail 52 is an extended portion at the rear of the frame 50, typically positioned above the web of the shooter's hand. It enhances ergonomics by allowing for a higher grip and reducing the risk of slide bite during recoil. The integral beavertail contributes to improved control, recoil management, and overall shooting comfort. Furthermore, the integral beavertail 52 can include a beavertail recess 53 that is a recess on the beavertail 52. The beavertail recess 53 can be configured such that the hammer 60 in the depressed position fits within the beavertail recess 53.

The present embodiments further include a method of assembling a firearm. The method starts by engaging a mainspring assembly 100 with a frame 50. The mainspring assembly 100 and frame 50 are brought together, aligning the respective components. The next step is sliding the mainspring assembly 100 vertically downward into position relative to the frame 50. This vertical movement ensures that the mainspring assembly 100 properly aligns with the designated location within the frame 50, preparing it for secure attachment. Upon moving the mainspring assembly 100 into position, the mainspring assembly 100 is secured to the frame 50. This secure attachment involves fastening the mainspring assembly 100 to the frame 50 using appropriate attachment means, such as screws, pins, or other fastening elements. By securing the mainspring assembly 100 to the frame 50, the position of the mainspring 120 within the firearm is also fixed relative to the frame 50. Once the mainspring assembly 100 is securely in position, the next step is installing a hammer 60 and a hammer strut 70. The hammer 60 is affixed to the upper portion of the frame and is responsible for striking the firing pin or primer of a cartridge. The hammer strut 70 extends between the hammer 60 and the mainspring assembly 100, transmitting force and energy during firearm operation. The installation of the hammer 60 and hammer strut 70 typically involves proper alignment and engagement with their respective components, ensuring smooth and controlled movement during the firing cycle. By following this method, the firearm is assembled with the mainspring assembly 100 secured in position, allowing for the proper functioning of the mainspring 120, hammer 60, and hammer strut 70 within the firearm.

In some aspects, the techniques described herein relate to a firearm including: a frame; a hammer pivotally coupled to an upper portion of the frame; a mainspring assembly coupled to a lower portion of the frame; a hammer strut extending between the hammer and the mainspring assembly; the mainspring assembly including: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame; a retention mechanism configured to secure the mainspring assembly in position relative to the frame, thereby securing the position of the mainspring relative to the frame; wherein the retention mechanism extends through a portion of the frame into engagement with the retention clip, securing the mainspring assembly relative to the frame by way of the retention clip.

In some aspects, the techniques described herein relate to a firearm, wherein the frame includes a beavertail portion at a rear end of the frame.

In some aspects, the techniques described herein relate to a firearm, wherein beavertail is located under the hammer such that the shooter's hand is guarded from the hammer and a slide.

In some aspects, the techniques described herein relate to a firearm, wherein the beavertail includes a relief to configured to receive the hammer when the hammer is in a depressed position.

In some aspects, the techniques described herein relate to a firearm, wherein the retention mechanism includes a threaded screw extending through the frame and engaging with the retention clip, thereby securing the mainspring assembly in position relative to the frame.

In some aspects, the techniques described herein relate to a firearm, wherein the mainspring includes a coiled spring element.

In some aspects, the techniques described herein relate to a firearm, wherein at least a portion of the mainspring assembly is fabricated from a steel alloy, a polymer, or a carbon fiber.

In some aspects, the techniques described herein relate to a mainspring assembly including: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame;

In some aspects, the techniques described herein relate to a mainspring assembly, wherein the top end of the main body of the mainspring assembly further includes a recessed cavity configured to securely receive and retain the distal end of the hammer strut.

In some aspects, the techniques described herein relate to a mainspring assembly, wherein at least a portion of the mainspring assembly is fabricated from a steel alloy, a polymer, or a carbon fiber.

In some aspects, the techniques described herein relate to a mainspring assembly, wherein the mainspring includes a coiled spring element.

In some aspects, the techniques described herein relate to a mainspring assembly, wherein the mainspring assembly is configured to be slid vertically downward into a cavity within the frame.

In some aspects, the techniques described herein relate to a mainspring assembly, wherein the retention mechanism includes a threaded screw extending through the frame and engaging with the retention clip, thereby securing the mainspring assembly in position relative to the frame.

In some aspects, the techniques described herein relate to a method of assembling a firearm: engaging a mainspring assembly with a frame of the firearm, wherein the mainspring assembly includes: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame; sliding the mainspring assembly vertically downward into position relative to the frame; securing the mainspring assembly to the frame, thereby securing a mainspring of the mainspring assembly in position relative to the frame; installing a hammer and a hammer strut after the mainspring assembly is secured in position.

Although embodiments of the present invention have been described herein in the context of a particular implementation in a particular environment for a particular purpose, those skilled in the art will recognize that its usefulness is not limited thereto and that the embodiments of the present invention can be beneficially implemented in other related environments for similar purposes. The invention should therefore not be limited by the above described embodiments, method, and examples, but by all embodiments within the scope and spirit of the invention as claimed.

Further, it is to be understood that the terminology used herein is for the purpose of describing particular embodiments only and is not intended to be limiting. The terms "a" or "an" as used herein, are defined as one or more than one. The term "plurality" as used herein, is defined as two or more than two. The term "another" as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper," "lower," "left," "rear," "right," "front," "vertical," "horizontal," and derivatives thereof relate to the invention as oriented in the figures and is not to be construed as limiting any feature to be a particular orientation, as said orientation may be changed based on the user's perspective of the device.

In the invention, various embodiments have been described with references to the accompanying drawings. It may, however, be evident that various modifications and changes may be made thereto, and additional embodiments may be implemented, without departing from the broader scope of the invention as set forth in the claims that follow. The invention and drawings are accordingly to be regarded in an illustrative rather than restrictive sense.

The invention is not to be limited in terms of the particular embodiments described herein, which are intended as illustrations of various aspects. Many modifications and variations can be made without departing from its spirit and scope. Functionally equivalent systems, processes and apparatuses within the scope of the invention, in addition to those enumerated herein, may be apparent from the representative descriptions herein. Such modifications and variations are intended to fall within the scope of the appended claims. The invention is to be limited only by the terms of the appended claims, along with the full scope of equivalents to which such representative claims are entitled.

The preceding description of exemplary embodiments provides non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

What is claimed is:

1. A firearm comprising:

a frame;

a hammer pivotally coupled to an upper portion of the frame;

a mainspring assembly coupled to a lower portion of the frame;

a hammer strut extending between the hammer and the mainspring assembly; the mainspring assembly comprising:

a main body having a top end configured to receive a distal end of the hammer strut and retain a top end of a mainspring;

a retention clip selectively secured to a second end of the main body, serving as a retention mechanism for a bottom end of the mainspring;

the main body of the mainspring assembly comprising corresponding opposed flanges facilitating slidable engagement of the mainspring assembly with the frame;

a retention mechanism configured to secure the mainspring assembly in position relative to the frame, thereby securing the position of the mainspring relative to the frame;

wherein the retention mechanism extends through a portion of the frame into engagement with the retention clip, securing the mainspring assembly relative to the frame by way of the retention clip.

2. The firearm of claim 1, wherein the frame comprises a beavertail portion at a rear end of the frame.

3. The firearm of claim 2, wherein the beavertail is located under the hammer such that the shooter's hand is guarded from the hammer and a slide.

4. The firearm of claim 3, wherein the beavertail comprises a relief to configured to receive the hammer when the hammer is in a depressed position.

5. The firearm of claim 1, wherein the retention mechanism comprises a threaded screw extending through the frame and engaging with the retention clip, thereby securing the mainspring assembly in position relative to the frame.

6. The firearm of claim 1, wherein the mainspring comprises a coiled spring element.

7. The firearm of claim 1, wherein at least a portion of the mainspring assembly is fabricated from a steel alloy, a polymer, or a carbon fiber.

8. A mainspring assembly comprising:

a main body having a top end configured to receive a distal end of a hammer strut and retain a top end of a mainspring;

a retention clip selectively secured to a second end of the main body, serving as a retention mechanism for a bottom end of the mainspring; and the main body of the mainspring assembly comprising corresponding opposed flanges facilitating slidable engagement of the mainspring assembly with a firearm frame.

9. The mainspring assembly of claim 8, wherein the top end of the main body of the mainspring assembly further comprises a recessed cavity configured to securely receive and retain the distal end of the hammer strut.

10. The mainspring assembly of claim 8, wherein at least a portion of the mainspring assembly is fabricated from a steel alloy, a polymer, or a carbon fiber.

11. The mainspring assembly of claim 8, wherein the mainspring comprises a coiled spring element.

12. The mainspring assembly of claim 8, wherein the mainspring assembly is configured to be slid vertically downward into a cavity within the frame.

13. The mainspring assembly of claim 8, wherein the retention mechanism comprises a threaded screw extending through the frame and engaging with the retention clip, thereby securing the mainspring assembly in position relative to the frame.

14. A method of assembling a firearm:

engaging a mainspring assembly with a frame of the firearm, wherein the mainspring assembly comprises:

a main body having a top end configured to receive a distal end of a hammer strut and retain a top end of a mainspring;

a retention clip selectively secured to a second end of the main body, serving as a retention mechanism for a bottom end of the mainspring;

the main body of the mainspring assembly comprising corresponding opposed flanges facilitating slidable engagement of the mainspring assembly with the frame;

sliding the mainspring assembly vertically downward into position relative to the frame;

securing the mainspring assembly to the frame, thereby securing a mainspring of the mainspring assembly in position relative to the frame;

installing a hammer and a hammer strut after the mainspring assembly is secured in position.

* * * * *